US005524789A

United States Patent [19]

Jackman

[11] Patent Number: 5,524,789

[45] Date of Patent: Jun. 11, 1996

[54] COLLAPSIBLE CONTAINER

[76] Inventor: Paul D. Jackman, 39 Park St., Hudson, Mass. 01749

[21] Appl. No.: 501,238

[22] Filed: Jul. 12, 1995

[51] Int. Cl.[6] ..... B65D 6/16

[52] U.S. Cl. ..... 220/666; 220/6; 215/900

[58] Field of Search ..... 229/117.01, 117.07; 215/900, 382; 220/666, 6, 907, 675, 669

[56] References Cited

U.S. PATENT DOCUMENTS

| | | | |
|---|---|---|---|
| 3,067,277 | 12/1962 | Nakazawa | 220/666 |
| 3,319,684 | 5/1967 | Calhoun | 220/666 |
| 3,354,924 | 11/1967 | Birrell et al. | 220/666 |
| 3,872,994 | 3/1975 | Hyde | 215/900 |
| 4,270,589 | 6/1981 | Heinzl | 215/900 |
| 4,405,077 | 9/1983 | Kupersmit | 229/117.07 |
| 5,209,372 | 5/1993 | Norwood | 220/666 |

FOREIGN PATENT DOCUMENTS

| | | | |
|---|---|---|---|
| 688612 | 6/1964 | Canada | 215/900 |
| 2678901 | 1/1993 | France | 229/117.01 |

*Primary Examiner*—Stephen J. Castellano
*Attorney, Agent, or Firm*—William Nitkin

[57] ABSTRACT

A collapsible container with four side faces, a top portion, a bottom and multiple score lines defined in each of the four side faces so that a one-quarter rotation of the top portion of the container while the bottom is held stationary causes the side faces to collapse and fold inward upon themselves along score lines on each side face.

1 Claim, 2 Drawing Sheets

COLLAPSIBLE CONTAINER

BACKGROUND OF THE INVENTION

1. Field of the Invention

The structure of this invention resides in the area of containers and more particularly relates to a container having inwardly collapsible sides to allow compaction thereof.

2. Description of the Prior Art

Collapsible containers are known in the prior art. An example of a typical collapsible container is found in Nolen, U.S. Pat. No. 3,254,825 which discloses a generally accordian-type container having collapsible sides which, when folded, cause the container to collapse and occupy less space. The same kind of structure is found in U.S. Pat. No. 3,921,897 to Noyes et al. In this patent the accordian-type collapsing occurs in cylindrical containers as well as rectangular containers with the accordian portions extending out from the container's sides, causing the container to have a larger footprint with the outwardly folded projections of its collapsed sides extending beyond its uncollapsed footprint. Containers with twisting portions have also been developed such as disclosed in U.S. Pat. No. 5,165,593 to Chuang which box-like container has a twisting top and panels which in one mode obstruct the opening and when the top is twisted, such panels no longer block the opening, thus opening the container. The goal of such a container was not to occupy less space but to provide a unitary resealable cap. In U.S. Pat. No. 3,237,840 to Keith a collapsible carton is taught with fold members around its sides such that when the top or bottom is rotated, the fold members collapse inward, causing the carton to collapse and occupy less space. Such a carton is generally made of cardboard formed from a die-cut and scored blank which is erected and folded into position.

SUMMARY OF THE INVENTION

It is an object of this invention to provide a new collapsible container that is made of paperboard or of thin plastic, such as a polyethylene, and provided in a cubical form. Generally in a preferred embodiment the container is designed to hold a gallon of liquid such as milk or any other desired liquid. For industrial purposes the container of this invention can be provided in a 2½ gallon or 5 gallon container. In such preferred embodiment the container can be molded of a unitary piece of plastic in a particular shape. The container has a top portion, a bottom and four vertically disposed side faces with each side face having three horizontal score lines and a diagonal score line forming fold lines, as described further below, such fold lines disposed below the top portion of the container. Upon a twisting of the semi-rigid top portion of the container through a 90-degree clockwise turn and applying downward pressure and maintaining the bottom of the container in stationary position, the container's side faces will collapse inward and it will occupy a fraction of its vertical dimension which is approximately one-quarter of its original height and still have the same footprint.

There are several advantages to providing a collapsible container for liquids. First, when empty non-collapsible plastic containers are now shipped, for example containers to be filled with milk, just as much shipping space is required to deliver such containers to the place of filling as would containers already filled. By using the collapsible container of this invention wherein in one preferred embodiment in a collapsed mode it occupies one-fourth of such shipping space, approximately four times the number of collapsed containers can be shipped by the same shipping mode, such as by truck. A great economy can be obtained by shipping containers of this invention in their collapsed state because so many more can be shipped and the cost per unit shipped is lowered compared to shipping non-collapsed containers. Once the containers of this invention have reached their filling locations, they can be erected, for example by air pressure directed therein and/or by machinery which will rotate them 90-degrees in a counterclockwise direction and they can be filled in the normal manner and sealed with caps, which caps are well known in the prior art. The filled containers then occupy a fixed footprint and have generally flat side faces. The container can be held by a handle formed within the top portion thereof and used in the normal way until the container is empty. Once the container is empty of liquid, the user can grasp its top portion and hold the bottom stationary. By then rotating the semi-rigid top portion of the container 90 degrees in a clockwise direction and exerting downward pressure while maintaining the bottom in position, the user can cause the side faces of the container to buckle inward along the plurality of score lines as described below. This action will cause the top of the container to collapse downward towards its bottom so that it again occupies approximately one-fourth the height and space that a non-collapsed container would occupy. The cap can be reapplied, and if airtight, will prevent the container from re-expanding as no air will be allowed therein.

Since the collapsed container of this invention occupies less space after usage, such containers are less costly to dispose of or to recycle. Currently plastic containers are the least profitable recyclable component because of volume considerations. Recycling large prior art one-gallon plastic fluid containers such as those containing milk or water, is presently not efficient because the bulk of the space in recycling bins and recycling trucks that pick up such containers is occupied by air within such containers. If collapsible containers were used, approximately four times as many containers could be held within the same truck for recycling and/or for other types of disposal. Thus there are significant advantages to utilizing collapsible containers such as taught by this invention.

DESCRIPTION OF THE PREFERRED EMBODIMENT(S)

Figure 1:
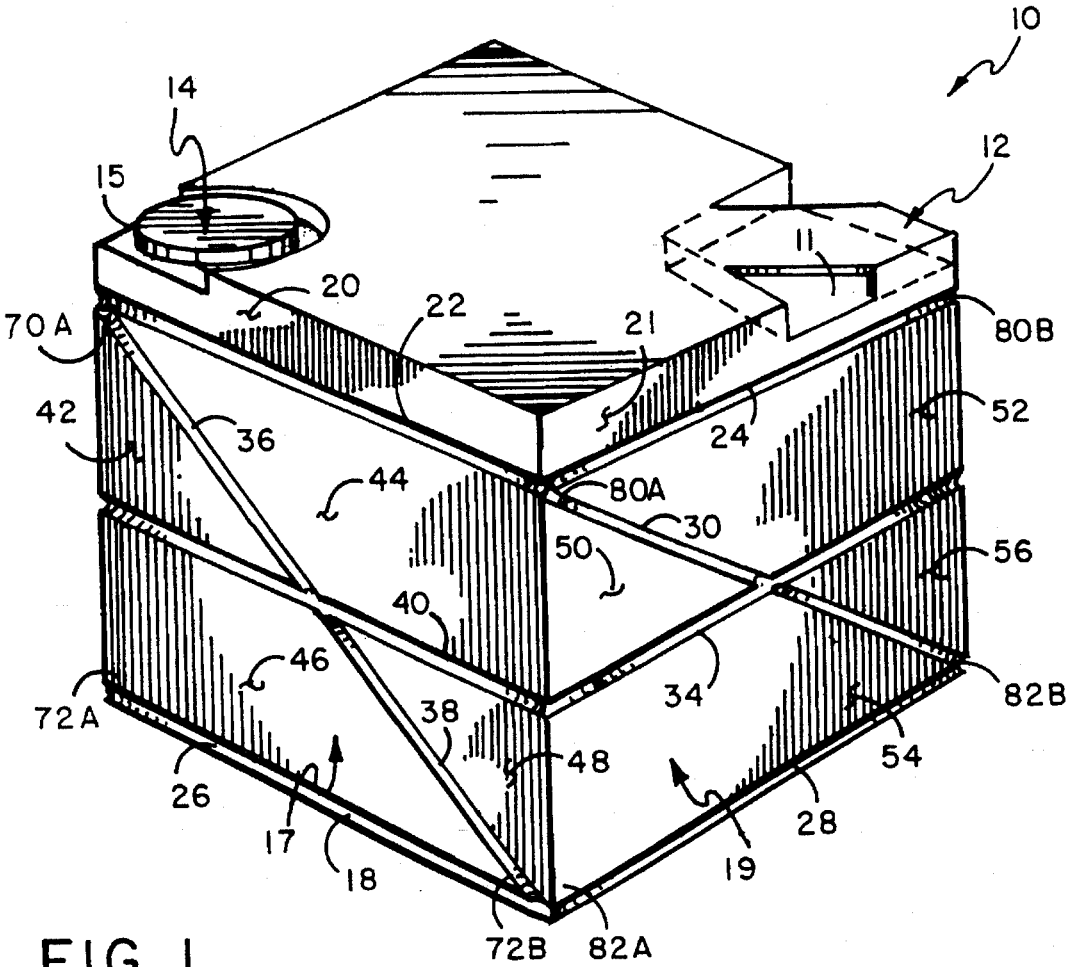
FIG. 1 illustrates a perspective view of the collapsible container of this invention.

FIG. 1 illustrates a perspective view of container 10 of this invention which in a preferred embodiment is cubical in shape, having four side faces with each side face having a left side and a right side, a top portion having a bottom portion, and a bottom. The side faces of the container can have a slight inward concavity to promote inward collapsing of the container when desired. A description of one side face is sufficient to describe each of the side faces of the container as they are each alike. At the top of container 10 is a top portion 16 at one corner of which is defined a closable opening 14 with a cap 15 thereon. Cap 15 is generally positioned on the container after the container has been filled. Although the container of this invention is described as holding a fluid, it should be understood that the container can also be utilized to hold pourable, non-liquid material as well. Once fluid is placed within the container, cap 15 can be installed thereon for later removal by the user of the container. Also on top portion 16, disposed in an opposite corner to opening 14, can be handle portion 12 formed of a part of top portion 16. Handle portion 12 can have a lower depressed area 11 formed thereunder so that the user can place his fingers around handle portion 12 for lifting and maneuvering the container.

Figure 2:
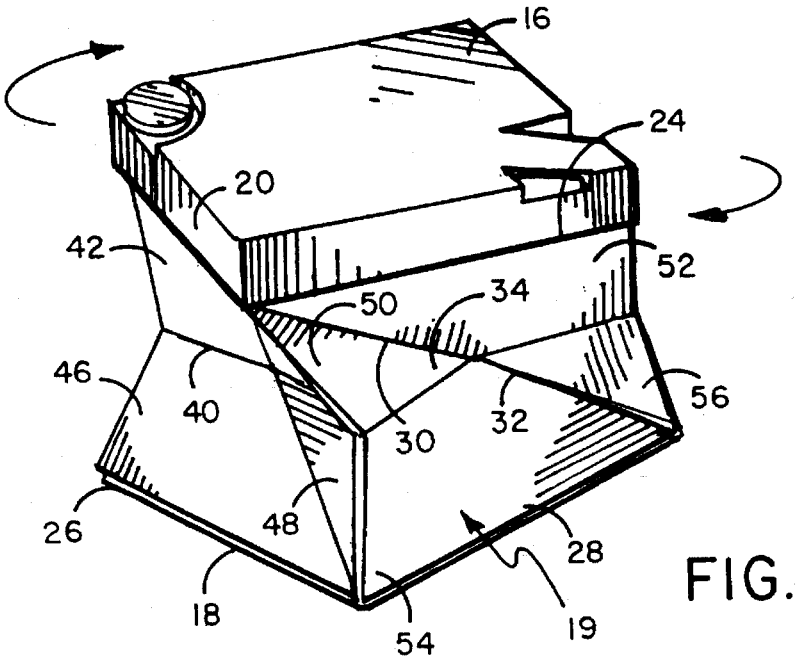
FIG. 2 illustrates a perspective view of the container of FIG. 1 starting to be twisted to cause the inward folding of its side faces.
Figure 3:
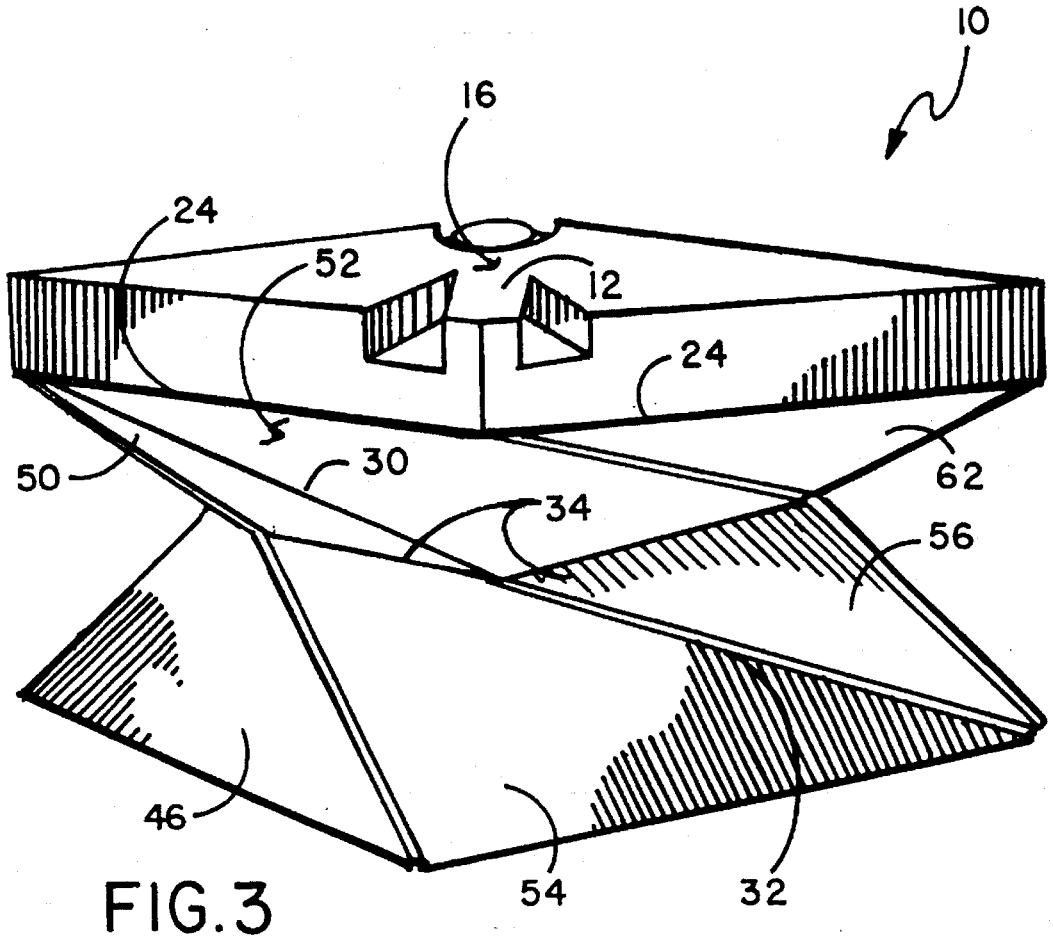
FIG. 3 illustrates a perspective view of the container of FIG. 2 further twisted to collapse downward toward its bottom.
Figure 4:
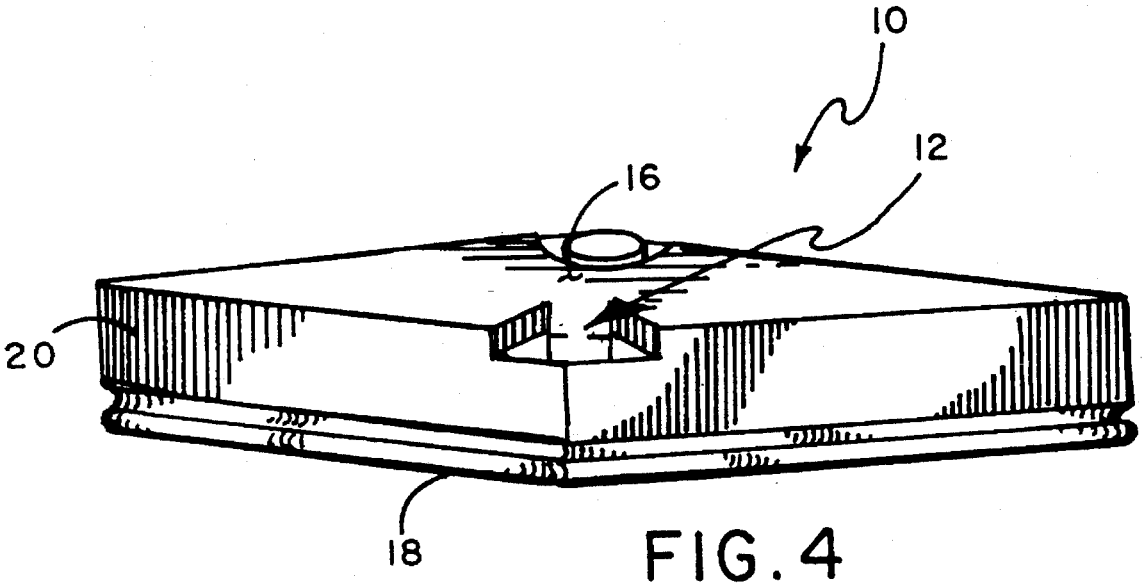
FIG. 4 illustrates the container of this invention in its completely collapsed state.

A series of score lines are defined on each of the side faces of the container along which score lines the container's side faces fold inward. Upper score line 22 on first face 17 of the structure extends horizontally somewhat below top portion 16 defining the bottom portion of top portion 16, and is aligned with upper score line 24 on second face 19 of the structure. The junction of upper score line 22 with the left side and right side of first face 17 forms, respectively, an upper left corner 70*a* and an upper right corner 70*b*. The junction of lower score line 26 with the left side and right side of first face 17 forms, respectively, a lower left corner 72*a* and a lower right corner 72*b*. Similarly, the junction of upper score line 24 with the left side and right side of second face 19 forms, respectively, an upper left corner 80*a* and an upper right corner 80*b* on second face 19. The junction of lower score line 28 with the left side and right side of second face 19 forms, respectively, a lower left corner 82*a* and a lower right corner 82*b*. It should be understood that the other two faces of the structure not seen in FIG. 1 have similar score lines that are identical to the score lines on first face 17. Upper score lines 22 and 24 are designed to allow the panels therebelow to be bent inward. An area above upper score line 22 forms an upper portion side 20 on first face 17 and upper portion side 21 on second face 19. These upper portion sides provide an area of the top portion for grasping the top of the container for the twisting process which is described below. At bottom 18 of the container is lower score line 26 on first face 17 and lower score line 28 on second face 19 which are parallel, respectively, to upper score line 22 and upper score line 24. Midway between upper score line 22 and lower score line 26 on first face 17 is defined middle score line 40. Similarly on second face 19 is defined middle score line 34 disposed midway between upper score line 24 and lower score line 28. On second face 19 is a diagonal line which extends from the upper left corner 80*a* and left side of upper score line 24 to lower right corner 82*b* and right side of lower score line 28. This diagonal line is continuous and is formed of an upper diagonal score line 30 and a lower diagonal score line 32. Bisecting this diagonal score line and running midway between upper score line 24 and lower score line 28 is horizontally disposed middle score line 34. This same structure is found in first face 17 with middle score line 40 extending horizontally disposed midway between upper score line 22 and lower score line 18 with a diagonal score line formed of upper diagonal score line 36 extending from the upper left corner 70*a* and the left side of upper score line 22 through middle score line 40 down to form lower diagonal score line 38 which extends to the lower right corner 72*b* and the right side of lower score line 26. Each of the four side faces of the container have similar sets of score lines formed thereon. For example, the score lines of first face 17 define an upper triangular panel 42 which is opposite lower triangular panel 48 and these triangular panels are, respectively, supplementary to upper trapezoidal panel 44 and lower trapezoidal panel 46. Similarly, second face 19 has an upper triangular panel 50 and a lower triangular panel 56 and an upper trapezoidal panel 52 and a lower trapezoidal panel 54. The other faces of the container have similar panels. As seen in FIG. 2, once one starts to rotate top portion 16 while maintaining bottom 18 in stationary position, second face 19 starts to buckle inward with the upper triangular panel 50 folding along middle score line 34 to bend over a portion of lower trapezoidal panel 54. In the same way upper trapezoidal panel 44 on first face 17 starts to bend under upper triangular panel 50 of second face 19 which cannot be seen in this view. This process occurs along each of the faces of the container as the top portion is rotated clockwise, causing an inward bending of the panels which start to collapse in on one another. As seen in FIG. 3, upper trapezoidal panel 52 folds almost on top of upper triangular panel 50, and lower triangular panel 56 folds over on top of a portion of lower trapezoidal panel 54. Upper trapezoidal panel 52 and lower triangular panel 56 form a first plane as the structure folds upon the inwardly moving diagonal score lines, and upper triangular panel 50 and lower trapezoidal panel 54 form a second plane that is disposed under the first plane when the diagonal score lines reach the vertical center line of the container as the top portion 16 realigns with the 90-degree offset bottom 18 after making its quarter turn. In a similar manner, upper trapezoidal panel 44 of first face 17 folds almost on top of upper triangular panel 42, and lower triangular panel 48 folds over on top of a portion of lower trapezoidal panel 46. Upper trapezoidal panel 44 and lower triangular panel 48 form a first plane as the structure folds upon the inwardly moving diagonal score lines, and upper triangular panel 42 and lower trapezoidal panel 46 form a second plane that is disposed under the first plane when the diagonal score lines reach a horizontal position in the container as top portion 16 realigns with the 90-degree offset bottom 18 after making its quarter turn. Partially through the quarter turn of top portion 16, the bending of the vertical sides of the faces offers some resistance to the twisting action. Greater effort is required to collapse container 10 during this initial quarter turn. Container 10 initially is in a relaxed position as seen in FIG. 1. As top portion 16 is turned and container 10 begins to collapse, the pressure increases, causing resistance to the rotation. This resistance or tension continues until a snap-closing point is reached which occurs after a 45-degree or one-half of the total 90-degree rotation of top portion 16. The snap-closing action is caused by the inward bending of the diagonal score lines on each face during the rotation of top portion 16. The tension is then gradually released as top portion 16 completes the full 90-degree turn, and container 10 collapses upon itself. In this way the panels of each face fold together over adjacent panels and have portions which start to extend inward into the empty area within container 10, allowing top portion 16 to be forced downward on top of bottom 18 of container 10 after a quarter rotation of top portion 16, as shown in FIG. 4, where top portion 16 is shown pushed down close to bottom 18. Upon collapsing, for example, upper right corner 80*b* is then positioned immediately above lower left corner 82*a* of second face 19. If the container has been shipped in this collapsed state, it can then be restored to its full height and filled with fluid for use; or if the contents of the container have been used and the container is empty, the container can then be disposed of as desired.

In manufacture by a molding process, the score lines can be formed by narrow, linear, inward protrusions within the mold forming the plastic container so that the container will bend inward at the resulting score lines. Each face of the container can be formed somewhat concavely. When the container is filled with liquid, the sides may remain slightly concave or may move outward to be flat depending on the gauge of the plastic used. When the container is empty, however, the inward bending of the concave sides helps the sides to bend and collapse inward, as described.

Although the present invention has been described with reference to particular embodiments, it will be apparent to those skilled in the art that variations and modifications can be substituted therefor without departing from the principles and spirit of the invention.

I claim:

1. A collapsible container having four side faces with each side face having a left side and a right side, a top portion having a bottom portion, and a bottom, comprising:

a closeable opening defined in said top portion;

three horizontal score lines disposed parallel to one another defined in each of said four side faces being an upper score line defined at said bottom portion of said top portion, a lower score line defined at said bottom, and a middle score line disposed midway therebetween, the junction of said upper score line with said left side and right side of said side face forming, respectively, an upper left corner and an upper right corner, and the junction of said lower score line with said left side and right side of said side face forming, respectively, a lower left corner and a lower right corner; and a diagonal score line defined in each of said four side faces, said diagonal score line extending from said upper left corner to said lower right corner of each of said side faces, said score lines on each side face defining four panels being an upper left triangular panel and a lower right triangular panel which are diagonally opposite one another and an upper right trapezoidal panel and a lower left trapezoidal panel, said upper left triangular panel being supplementary to its adjacent upper right trapezoidal panel; said lower right triangular panel being supplementary to its adjacent lower right trapezoidal panel, each of said side faces being the same such that when said top portion of said container is rotated clockwise 90 degrees with downward pressure with said bottom held stationary, said panels fold inwardly along said middle and diagonal score lines to cause a collapsing of said panels inwardly such that said bottom portion of said top portion moves to a position adjacent to said bottom.

* * * * *